US007684742B2

(12) United States Patent
Kamiya

(10) Patent No.: US 7,684,742 B2
(45) Date of Patent: Mar. 23, 2010

(54) IMAGE FORMING METHOD, AND IMAGE TRANSFERRING MECHANISM, A METHOD OF SCALE READING, A BELT TRANSFER UNIT, AND IMAGE FORMING APPARATUS, WHICH USE OR INCLUDE A NON-METALLIC SCALE WITH A COLORED RESIN LAYER

(75) Inventor: Takuro Kamiya, Suginami-ku (JP)

(73) Assignee: Ricoh Company, Ltd., Tokyo (JP)

( * ) Notice: Subject to any disclaimer, the term of this patent is extended or adjusted under 35 U.S.C. 154(b) by 35 days.

(21) Appl. No.: 11/011,217

(22) Filed: Dec. 15, 2004

(65) Prior Publication Data

US 2006/0008301 A1 Jan. 12, 2006

(30) Foreign Application Priority Data

Dec. 15, 2003 (JP) ..... 2003-416529

(51) Int. Cl.
*G03G 15/01* (2006.01)

(52) U.S. Cl. ..... 399/303; 399/312

(58) Field of Classification Search ..... 399/301, 399/303, 308, 302, 312
See application file for complete search history.

(56) References Cited

U.S. PATENT DOCUMENTS

| | | | | |
|---|---|---|---|---|
| 3,161,521 | A * | 12/1964 | Cohn et al. | 430/161 |
| 6,075,547 | A | 6/2000 | Takeuchi | |
| 6,445,900 | B2 * | 9/2002 | Fukao et al. | 399/302 |
| 2003/0052957 | A1 * | 3/2003 | Yamada et al. | 347/116 |
| 2003/0119968 | A1 | 6/2003 | Hara et al. | |
| 2004/0127317 | A1 | 7/2004 | Takuroh et al. | |
| 2004/0175198 | A1 | 9/2004 | Kamiya | |
| 2004/0228663 | A1 | 11/2004 | Kamiya et al. | |

FOREIGN PATENT DOCUMENTS

| | | | |
|---|---|---|---|
| JP | 05134556 | A * | 5/1993 |
| JP | 05-323704 | | 12/1993 |
| JP | 10198179 | A * | 7/1998 |
| JP | 2002-072606 | | 3/2002 |
| JP | 2002-072607 | | 3/2002 |
| JP | 2002-108169 | | 4/2002 |
| JP | 2002-132009 | | 5/2002 |
| JP | 2002-244392 | | 8/2002 |
| JP | 2002-258574 | | 9/2002 |
| JP | 2003-057910 | | 2/2003 |
| JP | 2003-057914 | | 2/2003 |
| JP | 2003-122136 | | 4/2003 |
| JP | 2003-128292 | | 5/2003 |
| JP | 2003280484 | A * | 10/2003 |
| JP | 2004-061888 | | 2/2004 |
| JP | 2004-109706 | | 4/2004 |
| JP | 2004-198925 | | 7/2004 |
| JP | 2004-226867 | | 8/2004 |

OTHER PUBLICATIONS

Computer translation of cited reference JP11-24507A.*
Computer Translation of JP10-198179A.*
Patent Abstracts of Japan, JP 11-024507, Jan. 29, 1999.
Patent Abstracts of Japan, JP 2001-016883, Jan. 19, 2001.
Patent Abstracts of Japan, JP 10-232566, Sep. 2, 1998.

* cited by examiner

*Primary Examiner*—Quana M Grainger
(74) *Attorney, Agent, or Firm*—Oblon, Spivak, McClelland, Maier & Neustadt, L.L.P.

(57) ABSTRACT

An image forming apparatus includes an image transferring device having a belt transfer unit for effectively performing an image transfer operation. The belt transfer unit includes a transport mechanism transporting a toner image, a scale provided around an entire perimeter of a surface of the transferring member and including at least one colored resin layer, and a scale reading mechanism arranged facing the scale and reading the scale. With the above-described belt transfer unit, a feedback control can effectively be performed to maintain constant reading accuracy and to prevent a voltage leak from a transfer mechanism.

22 Claims, 5 Drawing Sheets

IMAGE FORMING METHOD, AND IMAGE TRANSFERRING MECHANISM, A METHOD OF SCALE READING, A BELT TRANSFER UNIT, AND IMAGE FORMING APPARATUS, WHICH USE OR INCLUDE A NON-METALLIC SCALE WITH A COLORED RESIN LAYER

CROSS REFERENCE TO RELATED APPLICATIONS

The present patent document claims priority under 35 U.S.C. §119 to Japanese Patent Application No. 2003-416529 filed on Dec. 15, 2003 in the Japanese Patent Office, the entire contents of which are hereby incorporated herein by reference.

BACKGROUND OF THE INVENTION

1. Field of the Invention

The present invention relates to a method and apparatus for electrophotographic image forming. In particular, the present invention relates to a method and apparatus for electrophotographic image forming capable of effectively performing an image transfer operation.

2. Discussion of the Background

Recent market trends indicate a strong demand for electrophotographic image forming apparatuses having a function of printing color images. In response to the market demands, the availability of color electrophotographic image forming apparatuses, such as color copying machines and color printers, has remarkably increased.

The color electrophotographic image forming apparatuses can generally be classified into two types, that is, a one drum image forming apparatus and a tandem image forming apparatus.

The one drum image forming apparatus includes a photoconductive element having a plurality of image developing units around the photoconductive element. These image developing units electrically hold respective toners of different colors to sequentially form each of respective toner images on a surface of the photoconductive element. These respective toner images are then overlaid onto a recording sheet so that a full-color image is formed.

The tandem image forming apparatus includes a plurality of photoconductive elements and a plurality of developing units corresponding to the plurality of respective photoconductive elements. The plurality of developing units develop respective color toner images of different colors on the plurality of respective photoconductive elements. These color toner images are sequentially transferred onto a recording sheet to form a full-color image.

When comparing the one drum image forming apparatus and the tandem image forming apparatus, the following characteristics may be discerned.

The one drum image forming apparatus has an advantage that using only one photoconductive element makes a device relatively compact and inexpensive. However, the one drum image forming apparatus, which has one photoconductive element, needs to repeat its image forming operation several times (generally four times) to develop a full-color image. This process consumes a considerable amount of time.

The tandem image forming apparatus has an advantage that a plurality of photoconductive elements can reduce a time period of the image forming operation. However, the plurality of photoconductive elements make an image forming apparatus larger and more expensive.

Since the market requires a full-color image forming apparatus that performs its image forming operations at a speed equivalent to a monochrome image forming apparatus, the tandem image forming apparatus is attracting attention.

A tandem image forming apparatus includes a direct transfer system or an indirect transfer system.

In the direct transfer system, a plurality of photoconductive elements are arranged in parallel with a surface of a sheet transfer belt that forms an endless belt, and a plurality of transfer units having respective colors of yellow (y), magenta (m), cyan (c), and black (bk) are disposed in a vicinity of the plurality of respective photoconductive elements. Respective color toner images formed on surfaces of the plurality of photoconductive elements are sequentially transferred by the plurality of transfer units onto a recording sheet that is conveyed by the sheet transfer belt.

In the indirect transfer system, a plurality of photoconductive elements are arranged in parallel with a surface of an intermediate transfer member forming an endless belt. Respective color toner images formed on surfaces of the plurality of photoconductive elements are sequentially transferred and overlaid by a plurality of respective primary transfer units onto a surface of the intermediate transfer member so that an overlaid color toner image is formed. Subsequently, a secondary transfer unit transfers the overlaid color toner image onto a recording sheet. The secondary transfer unit may employ a transfer belt system or a roller system.

In the transfer belt system and the roller system, it has been a significant challenge to overlay a plurality of color toner images having different colors onto a transfer member without color shift. To achieve the above-described purpose, attempts have been made to rotate the sheet transfer belt and the intermediate transfer member at a constant rate.

One solution is to measure a surface speed with a linear encoder. The linear encoder performs a feedback control based on its output and uses the output to adjust the rate for writing. This system may efficiently be used to achieve accurate alignment.

It is, however, difficult to effectively form the linear encoder on an endless belt. In a case in which the endless belt has a surface that is clear and transparent, encoder marks may be printed on the clear surface of the endless belt so that the linear encoder can read the encoder marks to measure a surface speed of the endless belt. However, since transferring images needs a predetermined amount of conductivity, the endless belt should include conductive materials such as carbon material, which prevents the surface of the endless belt from being clear and transparent. As an alternative to the clear surface, a reflective linear encoder may be provided on the endless belt. The reflective linear encoder generally includes a metal etching or printing layer to obtain high reflectance.

The reflective linear encoder should be carefully positioned when it is disposed in a vicinity of a transfer unit that includes components having electrically high voltage such as a bias roller. When a creepage distance between the reflective linear encoder and the transfer unit is not sufficiently maintained, high voltage may leak from the transfer unit to the metal layer of the linear encoder, causing electromagnetic noises and deterioration in image quality. The above-described problems may occur in a tandem image forming apparatus and a one drum image forming apparatus, and should be solved to obtain images having higher quality.

SUMMARY OF THE INVENTION

In one exemplary embodiment, a novel image forming apparatus includes an image conveying member configured to convey a toner image on a surface thereof, a transport mechanism configured to transport the toner image from the image conveying member, a scale provided around an entire perimeter of a surface of the transport mechanism and having at least one colored resin layer, and a scale reading mechanism arranged to face the scale and configured to read the scale.

The at least one colored resin layer may include a colored resin film.

The at least one colored resin layer may include a transparent resin film and a colored adhesive layer.

The transport mechanism may include an intermediate transfer member arranged in a form of an endless belt and configured to receive the toner image from the at least one image conveying member.

The novel image forming apparatus may further include a primary transferring mechanism configured to transfer the toner image from the at least one image conveying member to the intermediate transfer member, and a secondary transferring mechanism configured to transfer the toner image from the intermediate transfer member onto a recording medium.

The transport mechanism may include a recording medium carrying member arranged in a form of an endless belt and configured to carry a recording medium to directly receive the toner image from the at least one image conveying member. In one exemplary embodiment, a novel method of image forming includes providing a scale with a plurality of pitch lines formed on at least one colored resin layer around an entire perimeter of a surface of a transport mechanism, rotating the transport mechanism, reading the scale according to light reflected by the plurality of pitch lines of the scale, and controlling the rotating based on information obtained by the reading.

The providing may include the at least one colored resin layer, which includes forming a colored resin film.

The providing may include the at least one colored resin layer, which includes forming a transparent resin film and a colored adhesive layer.

The novel method may further include optically writing an electrostatic latent image, conveying the electrostatic latent image, developing a toner image based on the electrostatic latent image, and transferring the toner image to the transport mechanism.

In one exemplary embodiment, a novel image transferring mechanism includes a transport mechanism configured to transport a toner image, a scale provided around an entire perimeter of a surface of the transferring member and having at least one colored resin layer, and a scale reading mechanism arranged to face the scale and configured to read the scale.

The transport mechanism of the novel image transferring mechanism may include an intermediate transfer member arranged in a form of an endless belt and configured to receive the toner image from an at least one-image conveying member.

The novel image transferring mechanism may further include a primary transferring mechanism configured to transfer the toner image from the at least one image conveying member to the intermediate transfer member, and a secondary transferring mechanism configured to transfer the toner image from the intermediate transfer member onto a recording medium.

The transport mechanism of the novel image transferring mechanism may include a recording medium carrying member arranged in a form of an endless belt and configured to carry a recording medium to directly receive the toner image from an at least one image conveying member.

In one exemplary embodiment, a novel method of scale reading may include providing a transport mechanism in a form of an endless belt, mounting a scale of a resin material with a plurality of pitch lines around an entire perimeter of a surface of a transport mechanism, rotating the transport mechanism, and reading the scale according to light reflected by the plurality of pitch lines of the scale.

The novel method of scale reading may further include transferring the toner image to the transport mechanism.

In one exemplary embodiment, a novel belt transfer unit includes a transport mechanism configured to transport a toner image, a scale provided around an entire perimeter of a surface of the transferring member, the scale including at least one colored resin layer, and a scale reading mechanism arranged to face the scale and configured to read the scale.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
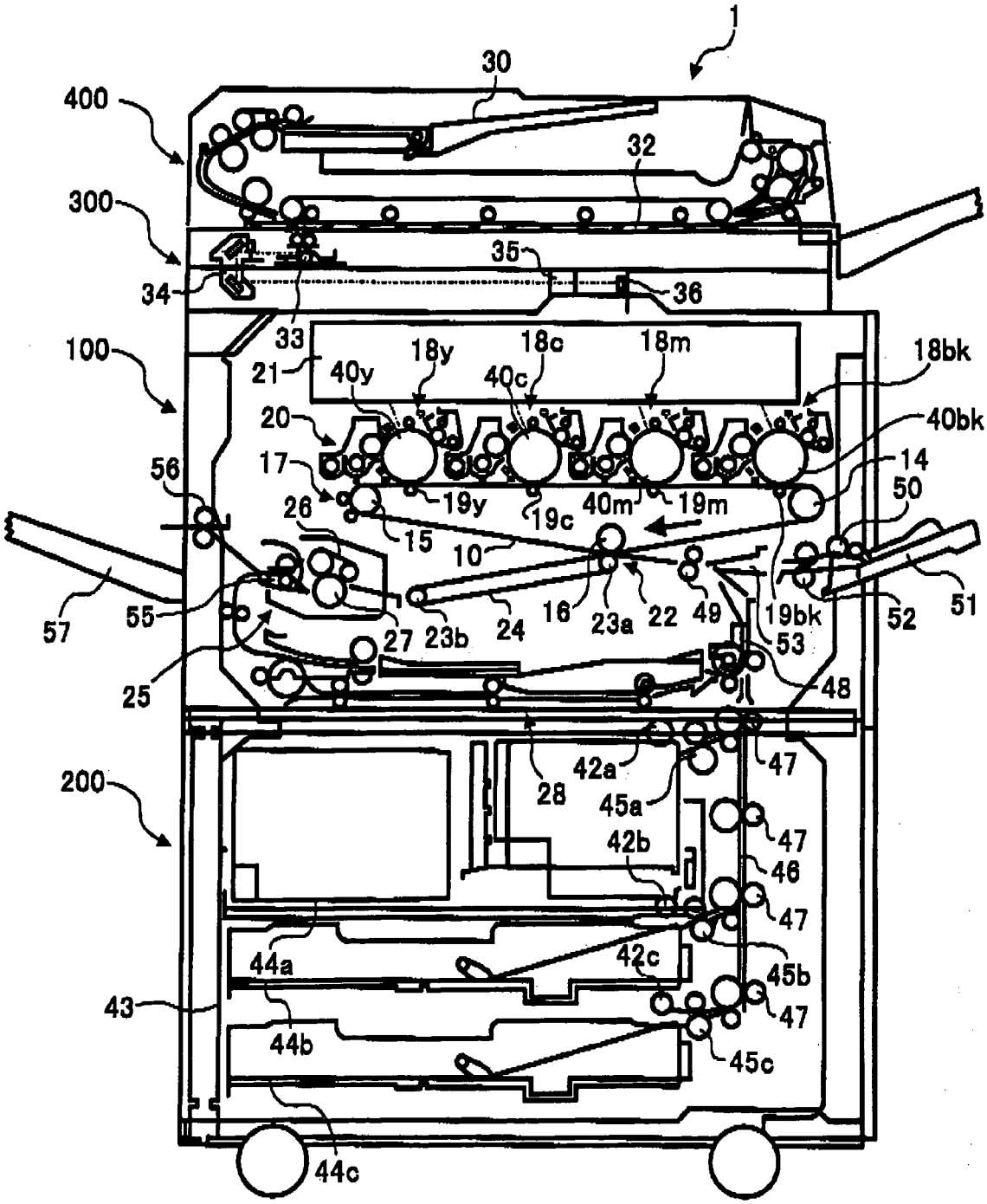
FIG. 1 is a schematic front view of an exemplary image forming apparatus according to an embodiment of the present invention.

In describing the embodiments of the invention illustrated in the drawings, specific terminology is employed for clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Referring to FIG. 1, a structure of a tandem-type color image forming apparatus 1 according to an exemplary embodiment of the present invention is now described.

The tandem-type color image forming apparatus 1 of FIG. 1 employs an indirect transfer system, and includes a color copying engine 100, a sheet feeding table 200, an image scanner 300, and an automatic document feeder (ADF) 400.

The color copying engine 100 is disposed on the sheet feeding table 200. The image scanner 300 is provided on the upper surface of the color copying engine 100. The automatic document feeder 400 is provided on the top of the image scanner 300.

In FIG. 1, the color copying engine 100 can include four image forming units 18*y*, 18*c*, 18*m*, and 18*bk* as a tandem-type image forming mechanism 20, an intermediate transfer member 10 as a transfer mechanism, a writing unit 21 as a writing mechanism, a fixing unit 25 as a fixing mechanism, and a portion of a sheet feeding mechanism that is mainly disposed in the sheet feeding table 200.

The four image forming units 18*y*, 18*c*, 18*m*, and 18*bk* of the tandem-type image forming mechanism 20 include four photoconductive elements 40*y*, 40*c*, 40*m*, and 40*bk*, respectively. The four photoconductive elements 40*y*, 40*c*, 40*m*, and 40*bk* can have similar structures and functions, except that the toners are different colors to form magenta images, cyan images, yellow images, and black images, respectively.

The four image forming units 18*y*, 18*c*, 18*m*, and 18*bk* are separately arranged at positions having horizontal heights or elevations forming the tandem-type image forming mechanism 20.

The photoconductive elements 40*y*, 40*c*, 40*m*, and 40*bk* separately receive respective light laser beams emitted by the writing unit 21, such that electrostatic latent images are formed on the surfaces of the four photoconductive elements 40*y*, 40*c*, 40*m*, and 40*bk*.

Respective charging rollers (not shown) are held in contact with the photoconductive elements 40*y*, 40*c*, 40*m*, and 40*bk* to charge respective surfaces of the photoconductive elements 40*y*, 40*c*, 40*m*, and 40*bk*.

Respective developing units (not shown) are separately disposed in a vicinity of or adjacent to the four image forming units 18*y*, 18*c*, 18*m* and 18*bk*, respectively. The respective developing units store the different colored toners for the image forming units 18*y*, 18*c*, 18*m*, and 18*bk*.

The writing unit 21 is provided at a position above the tandem-type image forming mechanism 20.

The transfer mechanism, which includes the intermediate transfer belt 10, is located or disposed below the tandem-type image forming mechanism 20 (substantially at the center of the tandem-type color image forming apparatus 1). The intermediate transfer member 10 forms an endless belt and is passed over or surrounds a plurality of supporting rollers 14, 15, and 16. The intermediate transfer member 10 is held in contact with the photoconductive elements 40*y*, 40*c*, 40*m*, and 40*bk*, and is driven to rotate clockwise as indicated by an arrow as shown in FIG. 1.

The intermediate transfer member 10 is formed of a base layer that is coated with an inextensible fluorine resin or an extensible rubber applied to an inextensible material such as a canvas. Provided on the base layer is an elastic layer. The elastic layer is made of, for example, a fluororubber or acrylonitrile-butadiene copolymer rubber. The surface of the elastic layer is covered with a smooth coat layer by coating a fluorine resin, for example.

In FIG. 1, an intermediate transfer member cleaning unit 17 is provided in the left side of the supporting roller 15. The intermediate transfer member cleaning unit 17 removes a residual toner on the intermediate transfer member 10 after image formation.

Four primary transfer units 19*y*, 19*c*, 19*m*, and 19*bk* are disposed inside a loop of the intermediate transfer member 10 to face the respective photoconductive elements 40*y*, 40*c*, 40*m*, and 40*bk*, which are accommodated in the image forming units 18*y*, 18*c*, 18*m*, and 18*bk*.

A secondary transfer unit 22 is located on the opposite side of the intermediate transfer member 10 from the tandem type image forming mechanism 20. The secondary transfer unit 22 includes a secondary transfer belt 24 that is an endless belt, and the transfer belt 24 is extended between two secondary transfer rollers 23*a* and 23*b*. The secondary transfer unit 22 is arranged such that a portion of the secondary transfer belt 24, which is close to the secondary transfer roller 23*a*, presses the intermediate transfer member 10 against the supporting roller 16. When a recording sheet is conveyed to a portion between the supporting roller 16 and the secondary transfer roller 23*a* of the secondary transfer belt 24, an overlaid color toner image formed on the surface of the intermediate transfer member 10 is transferred onto the recording sheet.

The fixing unit 25 is positioned at a lower left side of the color copying engine 100, in a vicinity of the secondary transfer roller 23*b* and below the supporting roller 15. The fixing unit 25 includes a fixing belt 26 and a pressure roller 27, and is configured to press the pressure roller 27 against the fixing belt 26 that is an endless belt.

The secondary transfer unit 22 also serves as a sheet transport mechanism for transporting a recording sheet having a color toner image thereon to the fixing unit 25. As an alternative to the secondary transfer unit 22, a transfer roller or a non-contact transfer charging unit may be used. With such a belt transport mechanism, it may be difficult to achieve a mechanism for transporting a recording sheet having a color toner image thereon to the fixing unit 25.

In the tandem-type color image forming apparatus 1 of FIG. 1, the color copying engine 100 is further provided with a sheet reverse unit 28 for reversing a recording sheet on one side of which an image is formed. Another image can be formed on the other side of the recording sheet for a duplex image forming operation in a duplex copy mode. The sheet reverse unit 28 is arranged under the secondary transfer unit 22 and the fixing unit 25, and is substantially parallel to the image forming mechanism 20.

While the color copying engine 100 includes several components, such as a sheet transporting passage 48 and a pair of registration rollers 49 serving as the sheet feeding mechanism, which will be described below, the sheet feeding mechanism is mainly arranged in the sheet feeding table 200.

The sheet feeding table 200, serving as the sheet feeding mechanism, is arranged in a lower portion of the tandem-type color image forming apparatus 1, and includes: sheet feeding rollers 42*a*, 42*b*, and 42*c*; a sheet bank 43; sheet feeding cassettes 44*a*, 44*b*, and 44*c*; sheet separation rollers 45*a*, 45*b*, and 45*c*; a sheet transporting passage 46; and a plurality of sheet feeding rollers 47.

Figure 2:
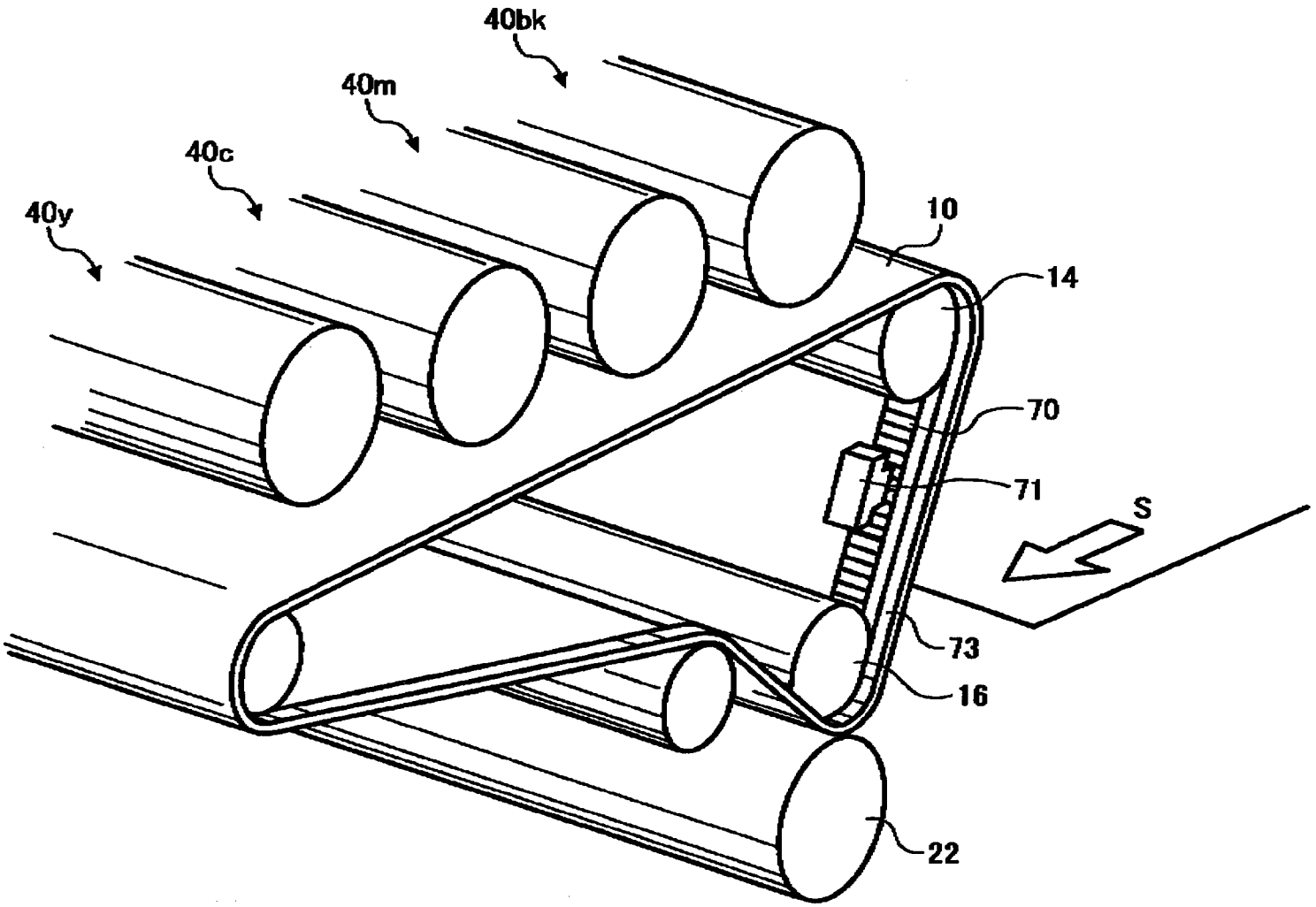
FIG. 2 is a schematic perspective view illustrating a position of a scale on a transfer member and a position of the corresponding sensor according to the present invention.

The sheet feeding cassettes 44*a*, 44*b*, and 44*c* are provided to the sheet bank 43 and are loaded with a stack of sheets of particular size, including a recording sheet S (shown in FIG. 2). When an image forming operation is performed, the recording sheet is fed from one of the sheet feeding cassettes 44*a*, 44*b*, and 44*c* and is conveyed toward the pair of registration rollers 49.

The sheet feeding mechanism also includes a manual sheet feeding tray 51, a switch pawl 55, a pair of sheet discharging rollers 56, and a sheet discharging tray 57.

The manual sheet feeding tray 51 is mounted on the right side of the color copying engine 100 of FIG. 1, and includes sheet discharging rollers 50, sheet separation rollers 52 and a manual sheet transporting passage 53. After opening the manual sheet feeding tray 51, an operator of the tandem-type color image forming apparatus 1 may feed sheets by hand.

The image scanner 300 includes an original document stacker 30 and a contact glass 32. The image scanner 300 also includes first and second moving units 33 and 34, an image forming lens 35, and an image reading sensor 36.

Operations of the above-described tandem-type color image forming apparatus 1 are now described.

Before starting an image forming operation, a set of original documents are placed in a face-up orientation on the original document stacker 30 of the ADF 400. Alternatively, the set of original documents can manually be placed sheet by sheet directly on the contact glass 32 of the image scanner 300. When each original document is directly placed on the contact glass 32, an operator lifts up the ADF 400 having a shell-like openable structure. After the original document is correctly placed, the operator lowers the ADF 400 to a closing position, thereby an entire surface of the original document placed on the contact glass 32 may be pressed by a lower surface of the ADF 400.

When a start button (not shown) is pressed, an uppermost sheet of the set of original documents placed on the ADF 400 is separated and is transported to the contact glass 32 of the image scanner 300 and, subsequently, the image scanner 300 is activated. That is, the first and second moving units 33 and 34 of the image scanner 300 slide in a predetermined direction. When the original document is manually set on the contact glass 32, the image scanner 300 is immediately activated upon the press of the start button.

The first moving unit 33, which includes a light source and a mirror (both not shown), causes a light beam to emit and deflect the light beam reflected by the original document placed on the contact glass 32. The second moving unit 34, which includes mirrors (not shown), receives the light beam reflected by the mirror or the first moving unit 33 and reflects the light beam to the image reading sensor 36 via the image forming lens 35.

When the start button is pressed, one of the supporting rollers 14, 15, and 16 is driven by a drive motor (not shown) to rotate the other two rollers. This causes the intermediate transfer member 10 to rotate. Subsequently, the image forming units 18*y*, 18*c*, 18*m*, and 18*bk* are driven to rotate the corresponding photoconductive elements 40*y*, 40*c*, 40*m*, and 40*bk*. This forms single color images in yellow, cyan, magenta, and black on the respective photoconductive elements 40*y*, 40*c*, 40*m* and 40*bk* in the image forming mechanism 20.

When the tandem-type color image forming apparatus 1 receives full color image data, each of the photoconductive elements 40*y*, 40*c*, 40*m*, and 40*bk* rotate in a clockwise direction in FIG. 1 and are uniformly charged with the corresponding charging rollers (not shown). The writing unit 21 emits the light beams corresponding to the respective color image data and irradiates the photoconductive elements 40*y*, 40*c*, 40*m*, and 40*bk* of the image forming units 18*y*, 18*c*, 18*m*, and 18*bk*, respectively. Electrostatic latent images corresponding to the respective color image data are formed on respective surfaces of the photoconductive elements 40*y*, 40*c*, 40*m*, and 40*bk*. The electrostatic latent images formed on the respective photoconductive elements 40*y*, 40*c*, 40*m*, and 40*bk* are visualized by the respective developing units (not shown), which contain respective color toners therein, into yellow, cyan, magenta, and black toner images, respectively. Those color toner images are sequentially overlaid on the surface of the intermediate transfer member 10 such that a composite color image is formed on the surface of the intermediate transfer member 10.

When the start button is pressed, the original document is scanned and a size of a copy sheet is determined. In a case in which a size of the copy sheet selected is equivalent to the recording sheet S accommodated in the sheet feeding cassette 44*a*, the sheet feeding roller 42*a* starts to rotate so that the recording sheet S is conveyed to the sheet separation roller 45*a* in the sheet feeding cassette 44*a*. The sheet separation roller 45*a* separates the recording sheet S from the following sheets and transfers the recording sheet S to the sheet transporting passage 46. The recording sheet S is conveyed by the plurality of sheet feeding rollers 47 through the sheet transporting passage 48 to the pair of registration rollers 49.

When manual insertion is used, the sheet feeding roller 50 is rotated to feed a set of recording sheets placed on the manual sheet feeding tray 51 to the pair of sheet separation rollers 52. Then, the pair of sheet separation rollers 52 separates an uppermost recording sheet from the set of recording sheets placed on the manual sheet feeding tray 51 and transfers the uppermost recording sheet, which will be referred to as the recording sheet S, to the pair of registration rollers 49 through the manual sheet transporting passage 53.

Then, the pair of registration rollers 49 stops and feeds the recording sheet S in synchronization with a movement of the composite color image towards a transfer area formed between the intermediate transfer member 10 and the secondary transfer unit 22. In particular, the transfer area is formed between a portion where the intermediate transfer member 10 is supported by the supporting roller 16 and a portion where the secondary transfer unit 22 is supported by the secondary transfer roller 23*a*. The composite color image formed on the surface of the intermediate transfer member 10 is transferred onto the recording sheet S at the transfer area.

The recording sheet S that has the composite color image thereon is further conveyed and passes through the fixing unit 25. The fixing unit 25 fixes the composite color image to the recording sheet S by applying heat and pressure.

As an alternative, the recording sheet S may be sent to the sheet reverse unit 28 when the switch pawl 55 selects a sheet transporting passage (not shown) for the duplex image forming operation. When the duplex image forming operation is performed, the sheet reverse unit 28 receives the recording sheet S, which on one side an image is formed. Recording sheet S is fed to the sheet reverse unit 28 after the recording sheet S is switched back to the face-down orientation at the sheet transporting passage of the sheet reverse unit 28. The sheet reverse unit 28 then transports the recording sheet S via the sheet transporting passage 48 to the pair of registration rollers 49 to pass through the transfer area formed between the intermediate transfer member 10 and the secondary image transfer unit 22 so that a next composite color image is transferred onto the back surface of the recording sheet S. Then, the recording sheet S, having composite color images printed on the front and back sides, is conveyed to the fixing unit 25.

After the recording sheet S passes through the fixing unit 25, the recording sheet S passes through a discharging passage selected by a switch pawl 55 and is discharged to a sheet discharging tray 57 via a pair of sheet discharging rollers 56.

After the composite color image is transferred onto the recording sheet S, the intermediate transfer member cleaning unit 17 removes residual toner on the surface of the intermediate transfer member 10 before a next image forming operation.

While the pair of registration rollers 49 are generally grounded, they may be biased to remove paper dust, for example, by using a conductive rubber roller (e.g., a conductive NBR rubber).

Referring now to FIG. 2, a detailed structure and operation of the intermediate transfer member 10 is described.

In FIG. 2, the intermediate transfer member 10 includes a linear scale 70, a scale reading sensor 71, and a regulating member 73.

The linear scale 70 is an optically readable scale provided in a vicinity of one end of the intermediate transfer member 10. The linear scale 70 is formed on an inner circumferential surface of the intermediate transfer member 10 over the entire circumference thereof.

The scale reading sensor 71 is arranged at a portion between the supporting rollers 14 and 16, oppositely facing a surface of the linear scale 70.

The regulating member 73 is provided on the one end of the inner surface of the intermediate transfer member 10 along the inner circumferential surface of the intermediate transfer member 10 to prevent a misalignment in a direction parallel to a rotating axis of each of the supporting rollers 14, 15, and 16.

Figure 3A:
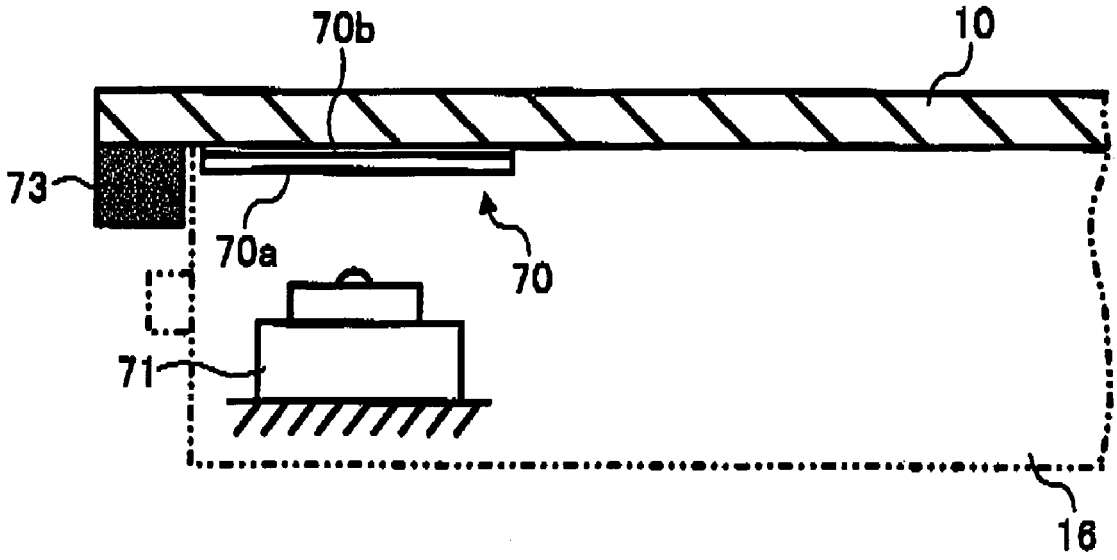
FIG. 3A is a fragmentary cross sectional view of a detailed position of a scale on the transfer belt and the corresponding sensor of FIG. 2.
Figure 3B:
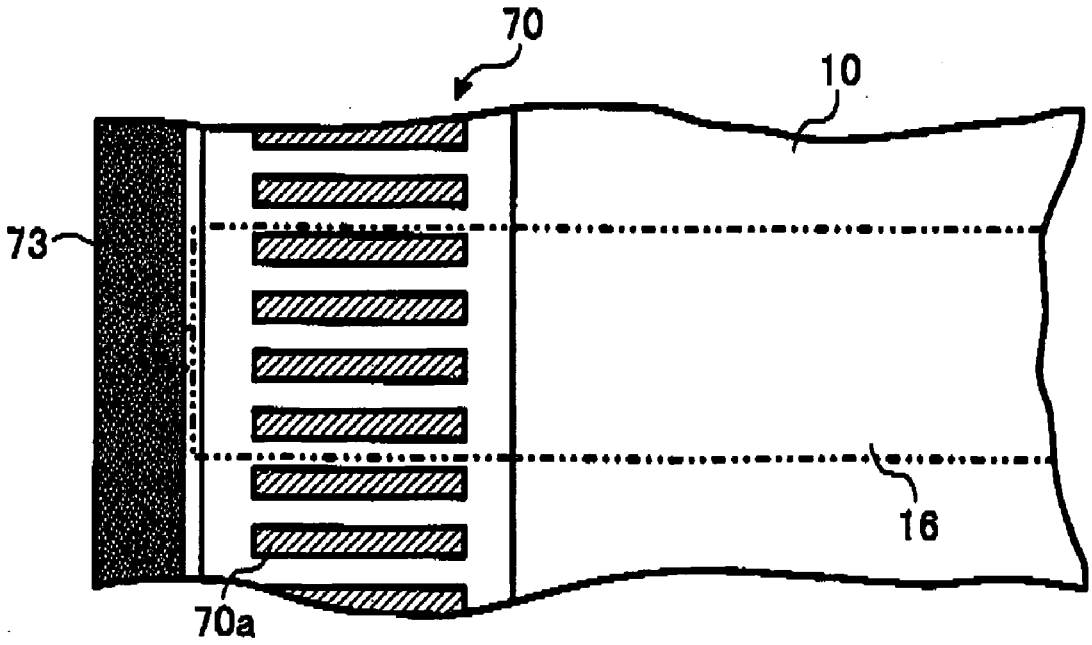
FIG. 3B is a partial view of the scale on the transfer belt viewed from the top of the transfer belt of FIG. 3A.

Referring now to FIGS. 3A and 3B, a detailed structure of the linear scale 70 is described.

As shown in FIG. 3A, the linear scale 70 includes a film layer 70*a* and an adhesive layer 70*b*. The film layer 70*a* and the adhesive layer 70*b* include nonmetallic resin material and may have a color of white or yellow so that high reflectance can be obtained. The film layer 70*a* includes a plurality of pitch lines having deep color arranged on the adhesive layer 70*b* at predetermined intervals as shown in FIG. 3B, and is disposed facing the scale reading sensor 71 as shown in FIG. 3A. The scale reading sensor 71 detects light reflected by the plurality of pitch lines of the linear scale 70 to read optical signals.

The scale 70 and the scale reading sensor 71 measure a linear velocity of the intermediate transfer member 10 to perform a feedback control to a drive source (not shown) of the supporting roller 14 of the intermediate transfer member 10, thereby driving the intermediate transfer member 10 with a high degree of positional accuracy. As previously described, the film layer 70*a* and the adhesive layer 70*b* include nonmetallic material, and thereby are electrically isolated from the transfer unit that includes the bias roller having high voltage. That is, even if the bias roller is disposed in a vicinity of the linear scale 70, voltage of the bias roller may not leak to the linear scale 70, which may maintain the electrical stability of the transfer unit.

Figure 5:
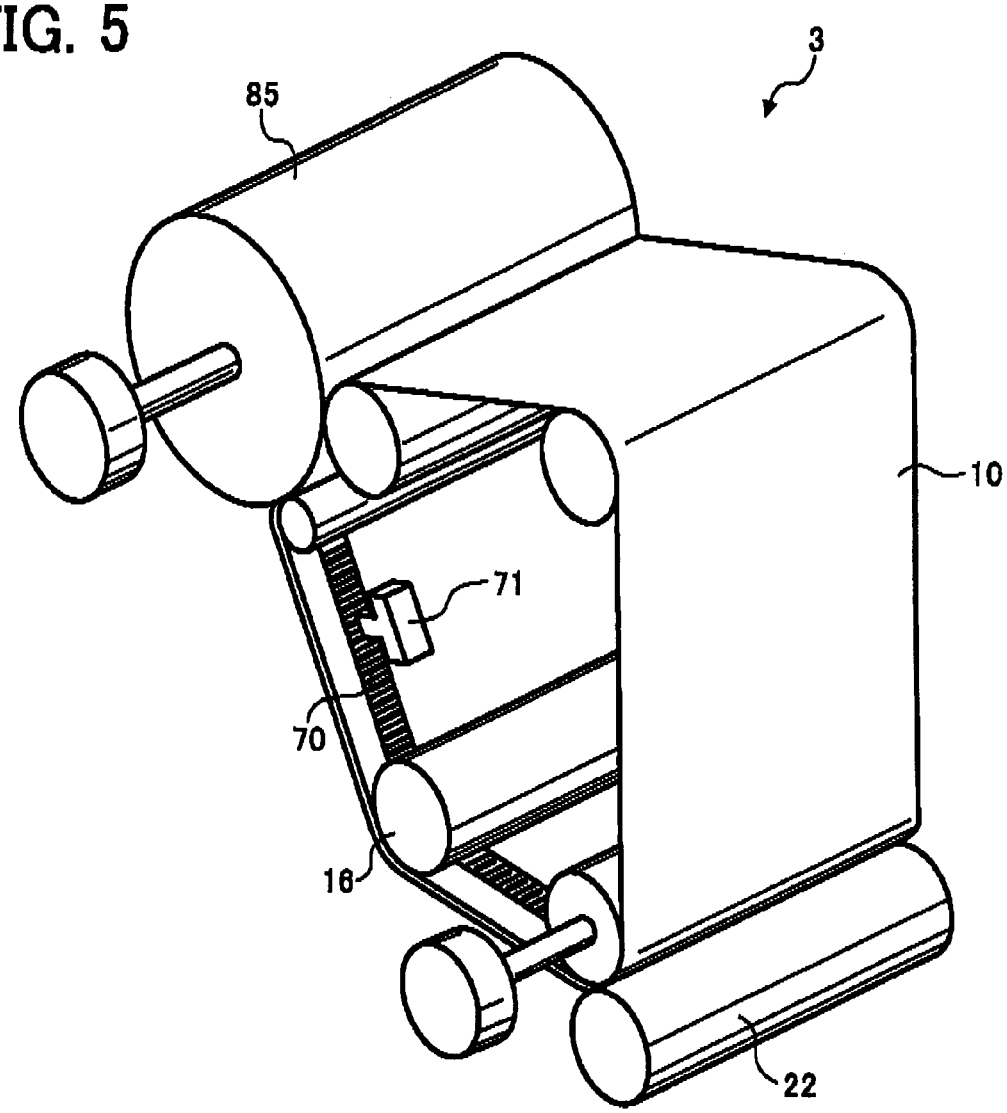
FIG. 5 is a schematic perspective view of the image forming apparatus of the present invention applied to an one-drum type apparatus.

Referring to FIG. 5, a tandem-type color image forming apparatus 2 with a tandem-type direct transfer system is now described. In the discussion below, components of the tandem-type color image forming apparatus 2 having similar functions to those of components shown in FIG. 1 are given the same reference numerals.

In the direct transfer system, four transfer units 81*y*, 81*c*, 81*m*, and 81*bk* for the colors of yellow, cyan, magenta, and black sequentially transfer images on respective photoconductive elements 40*y*, 40*c*, 40*m*, and 40*bk* arranged horizontally to a recording sheet S that is conveyed by a sheet conveyance belt 80 in a form of a rotatable endless belt 10.

Figure 4:
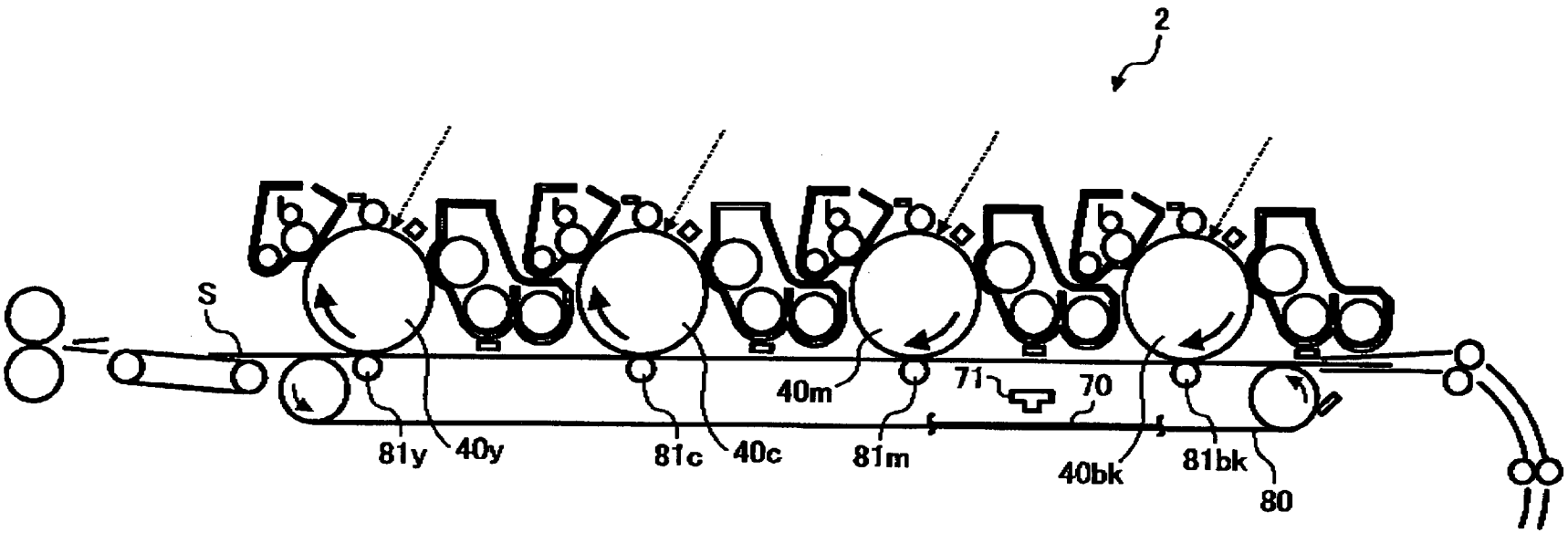
FIG. 4 is a schematic front view of the image forming apparatus of the present invention applied to a tandem type apparatus.

In FIG. 4, the linear scale 70 and the scale reading sensor 71 are disposed under the sheet conveyance belt 80 for understanding both relationships clearly. In practice, the linear scale 70 and the scale reading sensor 71 may be disposed as shown in FIGS. 3A and 3B. That is, the scale reading sensor 71 is provided in a range where the photoconductive elements 40*y*, 40*c*, 40*m*, and 40*bk* and the sheet conveyance belt 80 are in contact.

Referring to FIG. 5, a one-drum type color image forming apparatus 3 is described. In the discussion below, components of the one-drum type color image forming apparatus 3 having similar functions to those of components shown in FIG. 1 are given the same reference numerals.

The one-drum type color image forming apparatus 3 repeats four cycles of image forming operations to produce a full-color image.

In one cycle of the image forming operations, a drum-shaped photoconductive element 85 bears an electrostatic latent image of a single color on a surface thereof. The electrostatic latent image formed according to image data corresponding to the single color is developed as a toner image, and is transferred onto the intermediate transfer member 10 to form a composite color image. After four cycles of image forming operations similar to those as described above are performed, the composite color image on the intermediate transfer member 10 is transferred onto the recording sheet S (not shown) by the secondary transfer unit 22 to obtain a full-color image.

In FIG. 5, the linear scale 70 and the scale reading sensor 71 are disposed between and are in contact with the supporting roller 16 and the photoconductive element 85.

Figure 6:
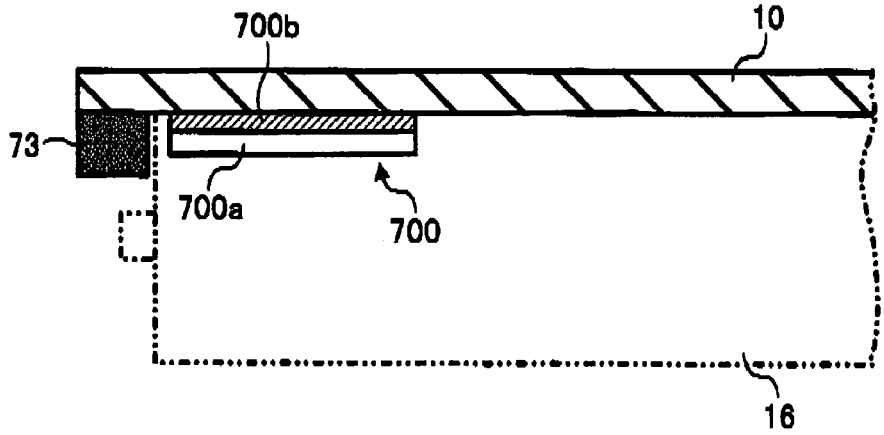
FIG. 6 is a fragmentary cross sectional view of a detailed position of scale on the transfer belt according to another exemplary embodiment of the present invention.

Referring to FIG. 6, a structure of another linear scale 700 according to a further embodiment of the present invention is now described. In the discussion below, components of the linear scale 700 having similar functions to those of components shown in FIGS. 3A and 3B are given the same reference numerals.

In FIG. 6, the linear scale 700 includes a transparent film 700*a* and an adhesive layer 700*b*. The adhesive layer 700*b* includes a white or light colored adhesive and a deep colored adhesive, forming a plurality of pitch lines of deep color at predetermined intervals, which is similar to the linear scale 70 shown in FIG. 3B.

With the structure of the linear scale 700 of FIG. 6, the plurality of pitch lines on the linear scale 700 are entirely covered with the transparent film 700*a*, thereby the linear scale 700 may be isolated from the voltage of a transfer unit having a bias roller, and may be prevented from mechanical abrasion.

Accordingly, the above-described techniques, according to the present invention, may be effectively applied to a transfer mechanism having an endless belt.

Numerous additional modifications and variations are possible in light of the above teachings. It is therefore to be understood that within the scope of the appended claims, the disclosure of this patent specification may be practiced otherwise than as specifically described herein.

The invention claimed is:

1. An image forming apparatus, comprising:

an image forming mechanism configured to form a toner image, the image forming mechanism including a transfer unit configured to be electrically charged, said transfer unit including a bias roller;

an image conveying member configured to convey the toner image on a surface thereof;

a transport mechanism configured to transport the toner image from the image conveying member;

a non-metallic scale provided around an entire perimeter of a surface of the transport mechanism, the scale including a transparent resin film covering an adhesive layer, the adhesive layer including a light colored adhesive with high reflectance and a deep colored adhesive with low reflectance forming a plurality of pitch lines of the deep color at predetermined intervals, the non-metallic scale being non-conductive and electrically isolated from the transfer unit by the transparent resin film so that electrical charge from the transfer unit does not leak to the non-metallic scale; and a scale reading mechanism arranged to face the non-metallic scale and configured to read the non-metallic scale optically.

2. The image forming apparatus according to claim 1, wherein the transport mechanism comprises:

an intermediate transfer member arranged in a form of an endless belt and configured to receive the toner image from the at least one image conveying member.

3. The image forming apparatus according to claim 2, further comprising:

a primary transferring mechanism configured to transfer the toner image from the at least one image conveying member to the intermediate transfer member; and a secondary transferring mechanism configured to transfer the toner image from the intermediate transfer member onto a recording medium.

4. The image forming apparatus according to claim 1, wherein the transport mechanism comprises a recording medium carrying member arranged in a form of an endless belt and configured to carry a recording medium to directly receive the toner image from the at least one image conveying member.

5. An image forming apparatus, comprising:

means for forming a toner image, said means for forming a toner image including a transfer unit configured to be electrically charged, said transfer unit include a bias roller;

means for carrying the toner image on a surface thereof;

means for transporting the toner image from the image conveying member;

non-metallic means for indicating information including a rotation speed of the means for transporting, the non-metallic means including a transparent resin film covering an adhesive layer, the adhesive layer including a light colored adhesive with high reflectance and a deep colored adhesive with low reflectance forming a plurality of pitch lines of the deep color at predetermined intervals, the non-metallic means being non-conductive and electrically isolated from the transfer unit by the transparent resin film so that the electrical charge from the transfer unit does not leak to the non-metallic means; and means for optically reading the information indicated by the non-metallic means for indicating.

6. The image forming apparatus according to claim 5, wherein the means for transporting comprises means for receiving the toner image from the means for carrying.

7. The image forming apparatus according to claim 6, further comprising:

primary means for transferring the toner image from the means for carrying to the means for receiving; and secondary means for transferring the toner image from the means for receiving onto a recording medium.

8. The image forming apparatus according to claim 5, wherein the means for transporting comprises means for conveying a recording medium to directly receive the toner image from the means for carrying.

9. A method of image forming, comprising:

forming an image on a transport mechanism using a transfer unit that is electrically charged, said transfer unit including a bias roller;

rotating the transport mechanism and a non-metallic scale provided around an entire perimeter of a surface of the transport mechanism, the scale including a transparent resin film covering an adhesive layer, the adhesive layer including a light colored adhesive with high reflectance and a deep colored adhesive with low reflectance forming a plurality of pitch lines of the deep color at predetermined intervals, the non-metallic scale being non-conductive and electrically isolated from the transfer unit by the transparent resin film so that electrical charge from the transfer unit does not leak to the non-metallic scale;

optically reading the non-metallic scale according to light reflected by the plurality of pitch lines of the non-metallic scale; and controlling the rotating based on information obtained by the reading.

10. The method according to claim 9, further comprising:

optically writing an electrostatic latent image;

conveying the electrostatic latent image;

developing a toner image based on the electrostatic latent image; and the forming includes transferring the toner image to the transport mechanism.

11. An image transferring mechanism, comprising:

a transport mechanism configured to transport a toner image, the transport mechanism including a transfer unit that is electrically charged, said transfer unit including a bias roller;

a non-metallic scale provided around an entire perimeter of a surface of the transport mechanism, the scale including a transparent resin film covering an adhesive layer, the adhesive layer including a light colored adhesive with high reflectance and a deep colored adhesive with low reflectance forming a plurality of pitch lines of the deep color at predetermined intervals, the non-metallic scale being non-conductive and electrically isolated from the transfer unit by the transparent resin film so that electrical charge from the transfer unit does not leak to the non-metallic scale; and a scale reading mechanism arranged to face the non-metallic scale and configured to read the non-metallic scale optically.

12. The image transferring mechanism according to claim 11, wherein the transport mechanism comprises:

an intermediate transfer member arranged in a form of an endless belt and configured to receive the toner image from an at least one image conveying member.

13. The image transferring mechanism according to claim 12, further comprising:

a primary transferring mechanism configured to transfer the toner image from the at least one image conveying member to the intermediate transfer member; and a secondary transferring mechanism configured to transfer the toner image from the intermediate transfer member onto a recording medium.

14. The image transferring mechanism according to claim 11, wherein the transport mechanism comprises a recording medium carrying member arranged in a form of an endless belt and configured to carry a recording medium to directly receive the toner image from an at least one image conveying member.

15. An image transferring mechanism, comprising:

means for transporting a toner image, said means for transporting including a transfer unit configured to be electrically charged, said transfer unit including a bias roller;

non-metallic means for indicating information including a rotation speed of the means for transporting, the non-metallic means including a transparent resin film covering an adhesive layer, the adhesive layer including a light colored adhesive with high reflectance and a deep colored adhesive with low reflectance forming a plurality of pitch lines of the deep color at predetermined intervals, the non-metallic means being non-conductive and electrically isolated from the transfer unit by the transparent resin film so that the electrical charge from the transfer unit does not leak to the non-metallic means; and means for reading the information indicated by the non-metallic means for indicating.

16. The image transferring mechanism according to claim 15, wherein the means for transporting comprises means for receiving the toner image from a means for carrying.

17. The image transferring mechanism according to claim 16, further comprising:

primary means for transferring the toner image from the means for carrying to the means for receiving; and secondary means for transferring the toner image from the means for receiving onto a recording medium.

18. The image transferring mechanism according to claim 15, wherein the means for transporting comprises means for conveying a recording medium to directly receive the toner image from means for carrying.

19. A method of scale reading, comprising the steps of:

electrically charging a transfer unit, said transfer unit including a bias roller;

rotating a transport mechanism, which is in a form of an endless belt, and a non-metallic scale provided around an entire perimeter of a surface of the transport mechanism, the scale including a transparent resin film covering an adhesive layer, the adhesive layer including a light colored adhesive with high reflectance and a deep colored adhesive with low reflectance forming a plurality of pitch lines of the deep color at predetermined intervals, the non-metallic scale being non-conductive and electrically isolated from the transfer unit by the transparent resin film so that electrical charge from the transfer unit does not leak to the non-metallic scale; and optically reading the non-metallic scale according to light reflected by the plurality of pitch lines of the non-metallic scale.

20. The method according to claim 19, further comprising:

transferring the toner image to the transport mechanism.

21. A belt transfer unit, comprising:

a transport mechanism configured to transport a toner image, the transport mechanism including a transfer unit that is configured to be electrically charged, said transfer unit including a bias roller;

a non-metallic scale provided around an entire perimeter of a surface of the transport mechanism, the scale including a transparent resin film covering an adhesive layer, the adhesive layer including a light colored adhesive with high reflectance and a deep colored adhesive with low reflectance forming a plurality of pitch lines of the deep color at predetermined intervals, the non-metallic scale being non-conductive and electrically isolated from the transfer unit by the transparent resin film so that electrical charge from the transfer unit does not leak to the non-metallic scale; and a scale reading mechanism arranged to face the non-metallic scale and configured to read the non-metallic scale optically.

22. A belt transfer unit, comprising:

means for transporting a toner image, the means for transporting includes a transfer unit configured to be electrically charged, said transfer unit including a bias roller;

non-metallic means for indicating information including a rotation speed of the means for transporting, the non-metallic means including a transparent resin film covering an adhesive layer, the adhesive layer including a light colored adhesive with high reflectance and a deep colored adhesive with low reflectance forming a plurality of pitch lines of the deep color at predetermined intervals, the non-metallic means being non-conductive and electrically isolated from the transfer unit by the transparent resin film so that the electrical charge from the transfer unit does not leak to the non-metallic means; and means for reading the information indicated by the non-metallic means for indicating optically.

* * * * *